US011402105B2

(12) United States Patent
Penuel et al.

(10) Patent No.: US 11,402,105 B2
(45) Date of Patent: Aug. 2, 2022

(54) SPILL PROOF WARMING DRAWER

(71) Applicants: BSH Home Appliances Corporation, Irvine, CA (US); BSH Hausgeräte GmbH, Munich (DE)

(72) Inventors: Michael Penuel, Swansboro, NC (US); Norman Sewell, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 873 days.

(21) Appl. No.: 16/212,761

(22) Filed: Dec. 7, 2018

(65) Prior Publication Data

US 2020/0182482 A1 Jun. 11, 2020

(51) Int. Cl.
*F24C 15/18* (2006.01)
*F24C 15/32* (2006.01)

(52) U.S. Cl.
CPC ..... *F24C 15/18* (2013.01); *F24C 15/322* (2013.01)

(58) Field of Classification Search
None
See application file for complete search history.

(56) References Cited

U.S. PATENT DOCUMENTS 1,349,567 A * 8/1920 Gammel ..... A47J 27/05 220/324
4,814,571 A * 3/1989 Bowen ..... H05B 6/6426 126/340
5,971,192 A * 10/1999 Immerman ..... A47K 3/281 206/771
6,124,572 A * 9/2000 Spilger ..... A47B 88/49 219/394
6,191,391 B1 2/2001 Deo et al.
6,666,348 B2 * 12/2003 Fore ..... B65D 1/26 220/315
7,082,783 B2 8/2006 Uihlein et al.
7,207,460 B2 * 4/2007 Sander ..... D06F 95/002 220/676
8,939,068 B2 1/2015 Cohen
8,960,824 B2 2/2015 Wilcox et al.
9,347,671 B2 5/2016 Bringe et al.
2002/0096056 A1 * 7/2002 Hopkins ..... A47J 36/06 99/422
2005/0173426 A1 * 8/2005 Iwamoto ..... H05B 6/6402 219/752

(Continued)

FOREIGN PATENT DOCUMENTS

CN 202092406 U 12/2011
KR 20100018235 A 2/2010

*Primary Examiner* — Joseph M. Pelham
(74) *Attorney, Agent, or Firm* — Michael E. Tschupp; Andre Pallapies; Brandon G. Braun

(57) ABSTRACT

A warming drawer insert is provided that can be situated into and removed from a warming drawer without tools via a series of flanges positioned along the walls of the warming drawer insert. These flanges also suspend the warming drawer insert in the warming drawer, and create an air gap to allow heated air to flow into the warming drawer through a series of vents positioned along the walls of the warming drawer. The warming drawer is also spill proof and prevents damage to the electric components of the warming drawer while also allowing for easy cleaning.

20 Claims, 7 Drawing Sheets

(56) References Cited

U.S. PATENT DOCUMENTS

| | | | | |
|---|---|---|---|---|
| 2005/0205081 | A1* | 9/2005 | Barker | F24C 15/162 126/190 |
| 2007/0158327 | A1* | 7/2007 | Morrow | A47B 77/08 219/385 |
| 2007/0158331 | A1* | 7/2007 | Morrow | A47J 36/2483 219/412 |
| 2009/0320882 | A1 | 12/2009 | Averwater | |
| 2010/0133263 | A1* | 6/2010 | Toyoda | H05B 6/6414 219/681 |
| 2010/0200563 | A1* | 8/2010 | Yoshidome | F24C 15/006 219/399 |
| 2010/0200575 | A1* | 8/2010 | Nakamura | H05B 6/76 219/756 |
| 2011/0079598 | A1* | 4/2011 | Bally | B65F 1/02 220/571 |
| 2011/0241503 | A1 | 10/2011 | Simon | |
| 2012/0055039 | A1* | 3/2012 | Watson | D06F 58/10 34/218 |
| 2012/0061386 | A1* | 3/2012 | Parsons | B65D 81/3446 219/734 |
| 2013/0008894 | A1* | 1/2013 | Nobue | H05B 6/6414 219/702 |
| 2017/0035244 | A1* | 2/2017 | Chatot | A23L 5/15 |

* cited by examiner

SPILL PROOF WARMING DRAWER

FIELD OF TECHNOLOGY

The present technology relates to improvements in drawer inserts; in particular, those inserts used in the warming drawers of ovens and/or ranges.

BACKGROUND

Traditional ranges, both free-standing and slide-in, often have a drawer located below the oven cavity that is accessible from outside of the range. Ovens mounted in cabinetry (i.e., "wall ovens") can also have a drawer located below the oven cavity.

This drawer traditionally provides one of two functions. The first function is that of a built-in storage drawer for holding associated pots, pans, and baking sheets. The second function is that of a warming drawer.

Typically, a warming drawer is used to keep food warm. Traditionally, the warming drawer is heated in some manner by a broiler or other heating element positioned in, above, or below the warming drawer. However, spills or debris in the warming drawer can cause damage to warming drawer components.

Accordingly, what is needed is a way to protect the sensitive electronics of the warming drawer from spills or debris, while still allowing for effective warming of items placed in the warming drawer.

BRIEF SUMMARY

The present invention is directed to an improved warming drawer insert. These improvements include streamlined construction, improved ease-of-use, improved cleanability, and improved protection and access for the warming drawer.

The warming drawer insert is a rectangular shaped tray designed to fit over the vertical walls of the warming drawer. The side walls and rear wall of the insert have flanges extending out from each wall, and further extending outwards in a downward angle. These flanges provide a secure fit to the vertical walls of the warming drawer while also providing a handle-like surface that can be easily grasped to remove the insert from the warming drawer. These flanges also allow the insert to have vents in the form of slots or outward and downward facing louvers in the two side walls and the rear vertical wall to allow for the even convective heating of the warming drawer housing and all consumable products placed in the warming drawer.

These improvements allow for a robust construction that is easily cleaned, spill proof, and more efficient and effective at keeping foodstuffs warm. Additionally, the removability of the insert allows for greater access to the electronic components of the warming drawer.

Various other objects, features, aspects, and advantages of the present invention will become more apparent to those skilled in the art upon review of the following detailed description of preferred embodiments of the invention and accompanying drawings in which like numerals represent like components.

DETAILED DESCRIPTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Throughout this disclosure, the terms top, bottom, front, back, left and right may be used. These terms are only intended to provide relational orientation with respect to one another. For example, any two opposed sides can be a right side and a left side and by changing to an opposed viewpoint, right versus left will be changed. Thus, top, bottom, front, back, left and right should not be considered limiting and are used only to distinguish their relationship to one another.

Figure 1:
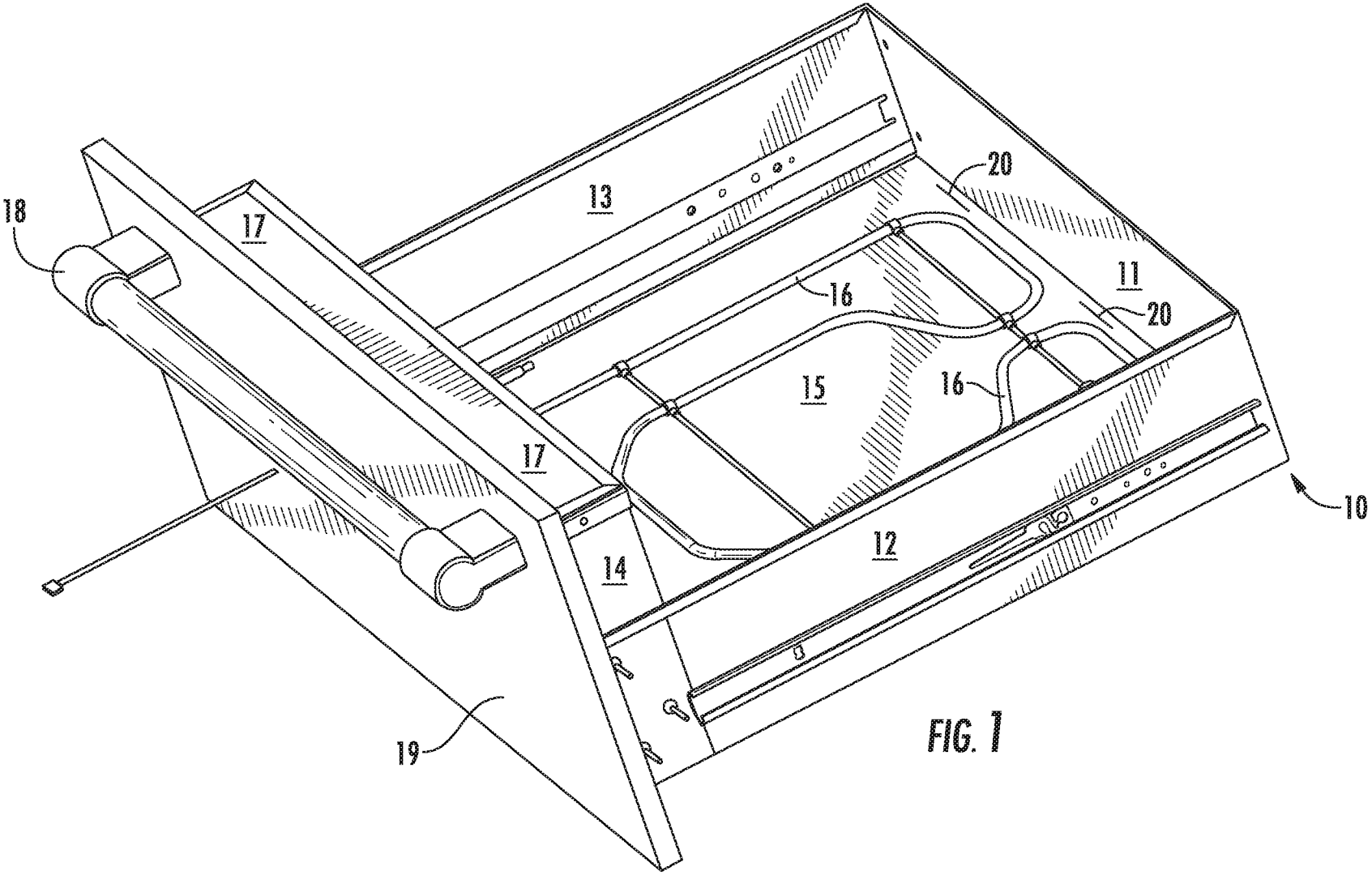
FIG. 1 is a perspective, upper view of an exemplary warming drawer.

With reference to FIGS. 2-7, these figures show examples of a warming drawer insert that can be inserted into the warming drawer depicted in FIG. 1.

Figure 2:
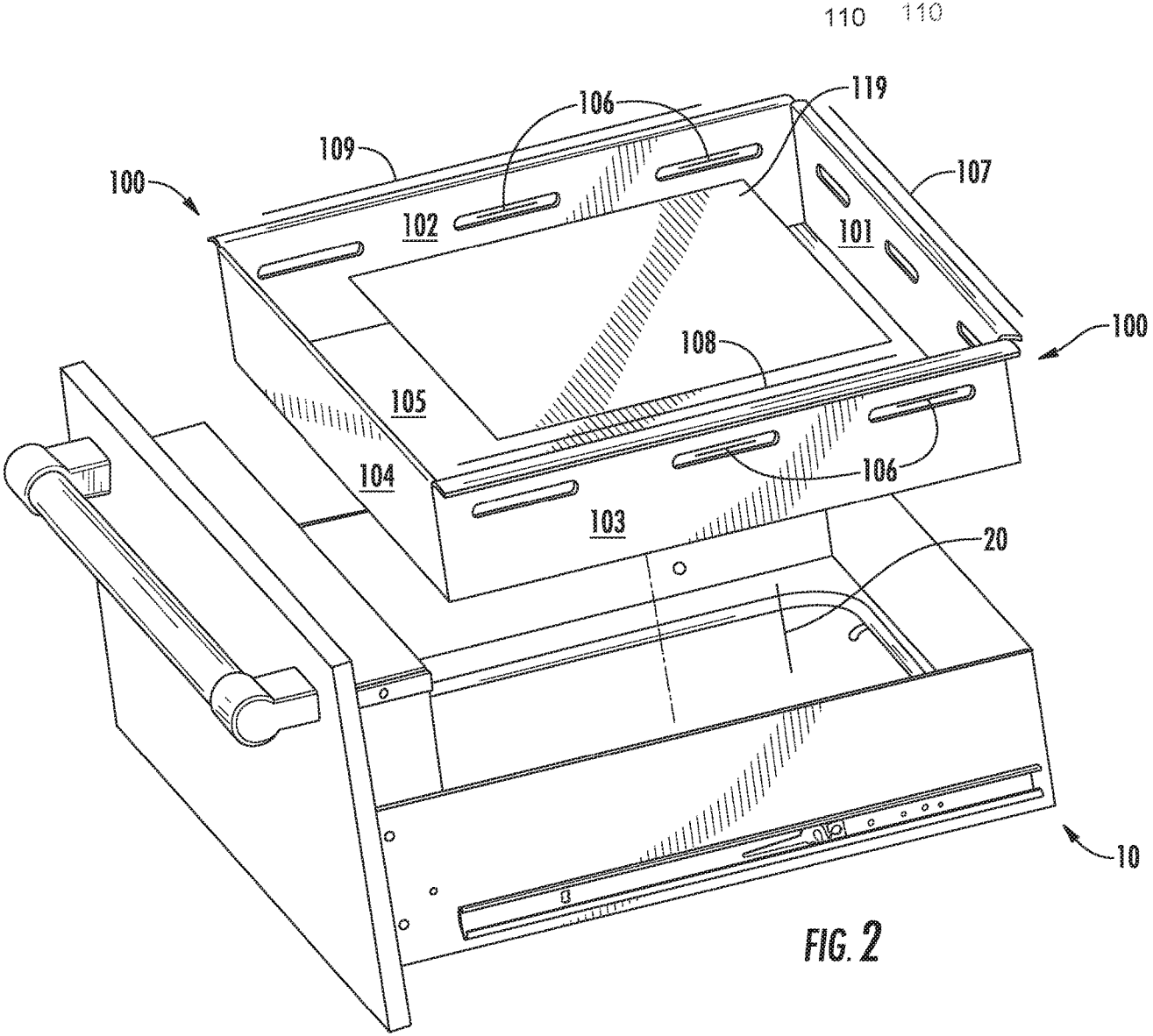
FIG. 2 is a perspective, upper view of an exemplary warming drawer insert and warming drawer.
Figure 3:
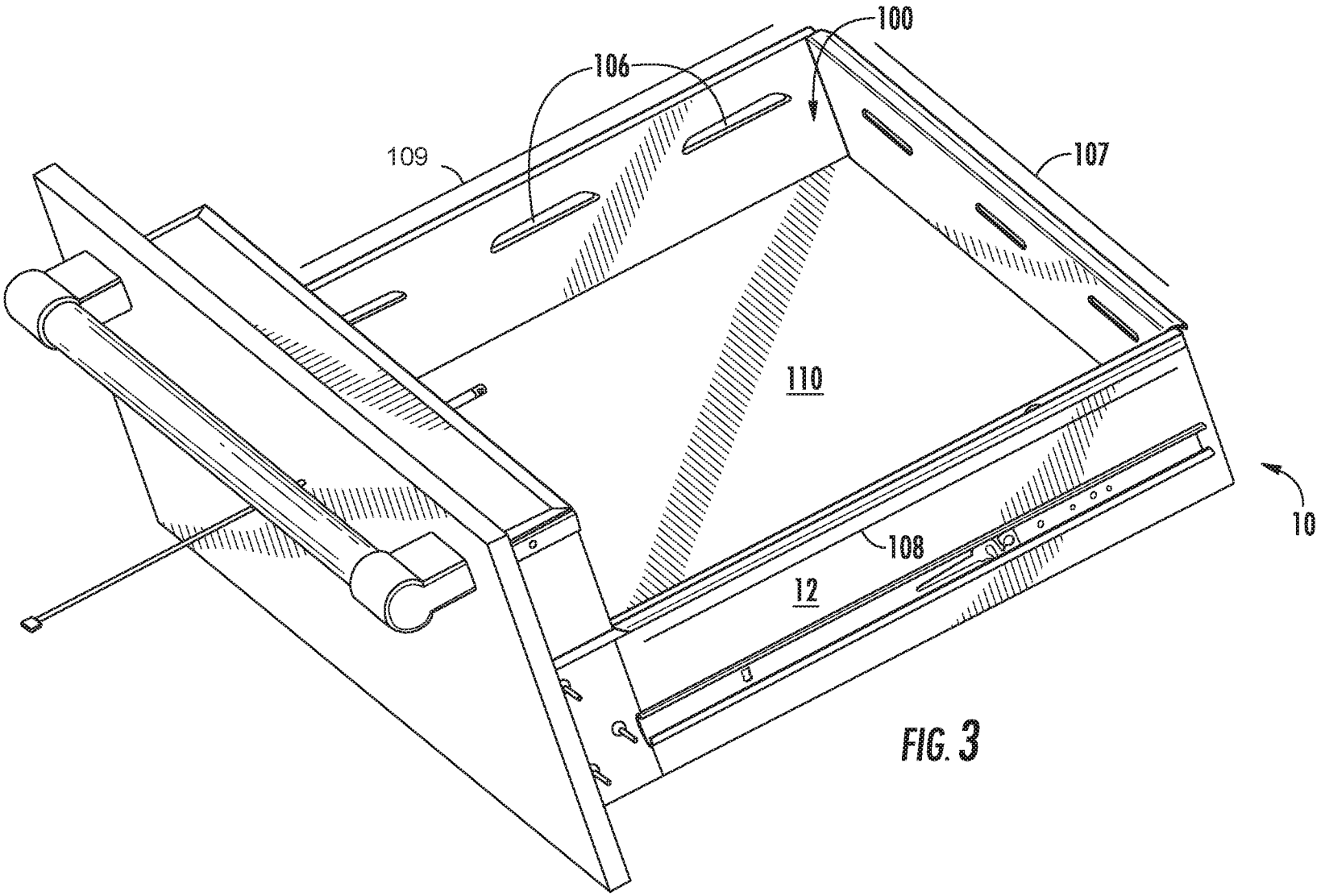
FIG. 3. is a perspective, upper view of an exemplary warming drawer insert situated in the warming drawer.

FIGS. 1-3 illustrate an angled perspective of an example warming drawer (10) without a warming drawer insert. This warming drawer is depicted as a warming drawer for a slide-in range, however, any suitable warming drawer for any range or oven may be used, for example, a slide-in range or a wall oven.

In reference to FIG. 1, the warming drawer (10) has a rear wall (11), a pair of side walls (12 & 13), and a front wall (14) that in conjunction with a bottom panel (15) define a warming drawer cavity (20). In this example, heat is generated by a heating element (16) disposed on the bottom of the warming drawer above the bottom panel. In this example, electronic components of the warming drawer are inside the front wall, a control panel (17) is disposed along the top of the front wall. Additionally, a front panel (19) is affixed to the front wall, and a handle (18) for opening the warming drawer is affixed to the front panel.

FIGS. 2-7 illustrate various example warming drawer inserts in accordance with embodiments of this invention.

FIG. 2 depicts a warming drawer insert (100) being inserted into the warming drawer cavity (20) of the warming drawer (10). As depicted, the warming drawer insert has a rear wall (101), a pair of side walls (102 & 103), and a front wall (104) that in conjunction with a bottom panel (105) define a warming area (110). As depicted, the warming drawer insert has a rectangular shape, however, the warming drawer insert can be constructed in an alternative shape to conform to the dimensions of the warming drawer cavity. The depicted warming drawer insert is constructed out of stainless steel, however, any suitable material may be used.

The warming drawer insert (100) is designed to fit over the vertical walls of the warming drawer (10) (specifically, the side walls (12 & 13) and the rear wall (11) of the warming drawer as depicted in FIG. 1). To facilitate this fitting and to hold the warming drawer insert in place, the side walls (102 & 103) and rear wall (101) of the warming drawer insert have flanges (107, 108, 109) that extend out from the top of the respective wall in a downward angled extension. While these flanges are a portion of the respective wall that has been bent or folded into position, it is possible for these flanges to be separate components that have been attached in some fashion to a respective wall.

These flanges provide a secure fit to the inner walls of the warming drawer, effectively suspending the warming drawer insert in the warming drawer. Furthermore, these flanges provide a handle-like surface for a consumer to easily grasp and remove the warming drawer insert, allowing for the insert to function as a warming drawer liner for easy cleaning and access to the electrical components of the warming drawer such as the heating element (16).

Suspending the warming drawer insert via the flanges results in an air gap being formed between the walls of the insert and the walls of the warming drawer. As a result, when the warming drawer is actively heating the warming drawer cavity (20) not only is the bottom panel (105) of the insert heated, but the air in the warming drawer as well creating the warming area (110). As a result, the hot air will rise and flow into the air gap along the sides and rear of the warming drawer insert.

To allow this heated air to circulate in and out of the warming drawer insert, the insert has a plurality of vents. The specific design of these vents can vary. For example, as depicted in FIG. 2 openings can be cut into the side and rear walls to create slots (106) which function as vents. While the example insert in FIG. 2 depicts three vents along the side and rear walls, a different number of vents can be used as well as alternative arrangements of the vents. Additionally, because there is an air gap between the walls of the insert and the walls of the warming drawer these vents can be embodied as louvres that extend outwards from the walls of the insert into the space of the air gap.

The combination of the flanges and the vents in the warming drawer insert allow for even convective heating of the insert and all consumable products placed in the warming drawer via passage of warm air through the air gap and vents.

FIG. 3 depicts the warming drawer insert (100) fully inserted into the warming drawer cavity (20) of the warming drawer (10). When inserted, the flanges (107, 108, 109) of the warming drawer insert suspend the insert in the warming drawer and extend slightly beyond the exterior walls (11, 12, 13) of the warming drawer. As a result of this extension these flanges allow the insert to be easily grasped and removed from the drawer without tools or difficulty.

Figure 4:
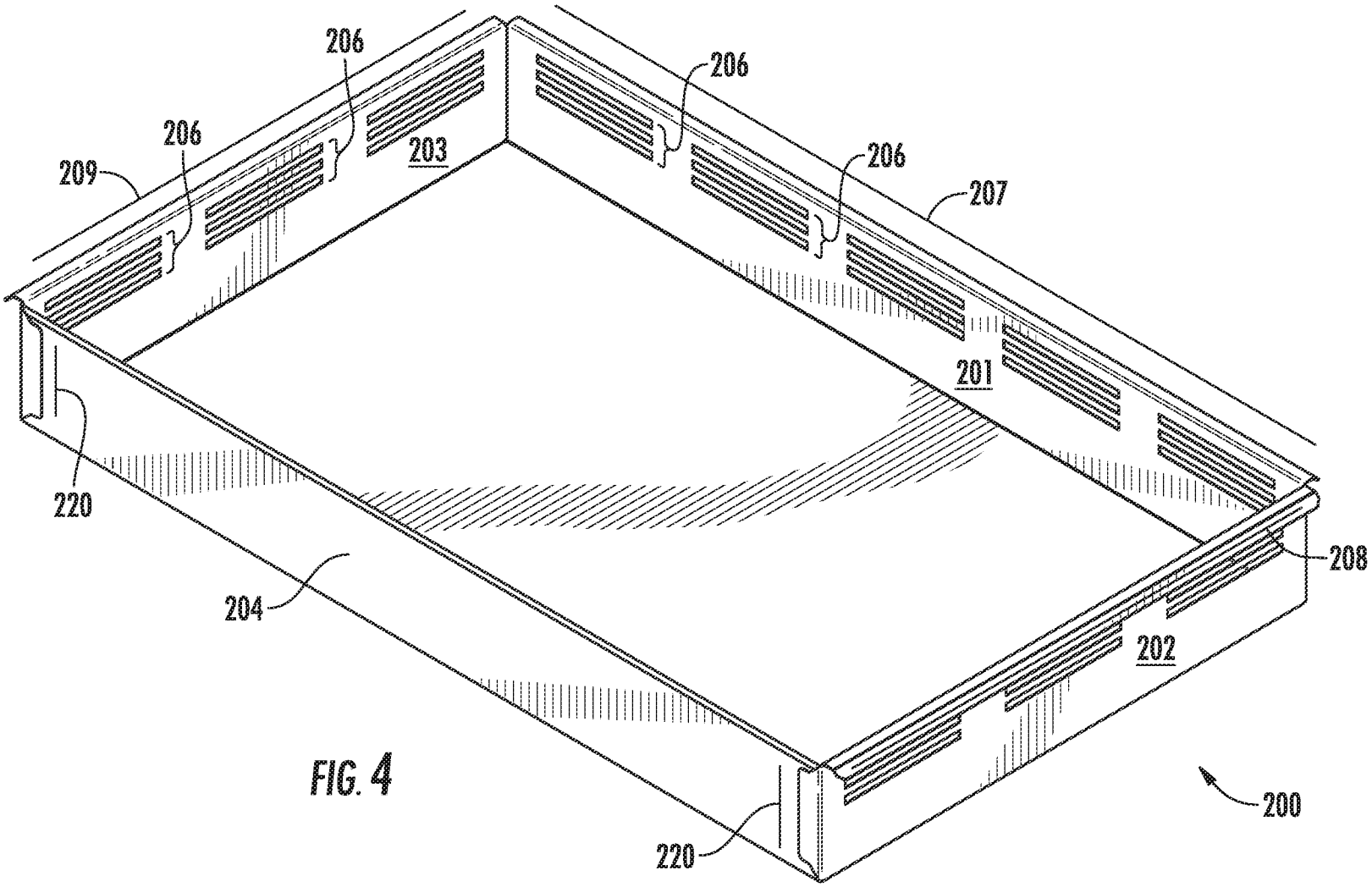
FIG. 4 is a perspective, upper view of a second exemplary warming drawer insert.

FIG. 4 depicts another example of a warming drawer insert (200), having a rectangular shape, flanges (207, 208, 209) along the side and rear walls (201, 202, 203), and slots (206) functioning as vents. In contrast to the warming drawer insert of FIGS. 2 and 3 (100), the insert of FIG. 4 has additional slots in an alternative arrangement to allow for different convective heating patterns.

FIG. 4 also depicts the side walls (202, 203) of the warming drawer insert having side tabs (220). These side tabs allow for more streamlined construction of the insert, allowing a manufacturer to utilize identical components for the side walls. When constructing the insert, the side walls are placed perpendicular to the front wall (204) and rear wall (201) and are attached to the side tabs via weld, adhesive, rivet, or other appropriate method.

Figure 5:
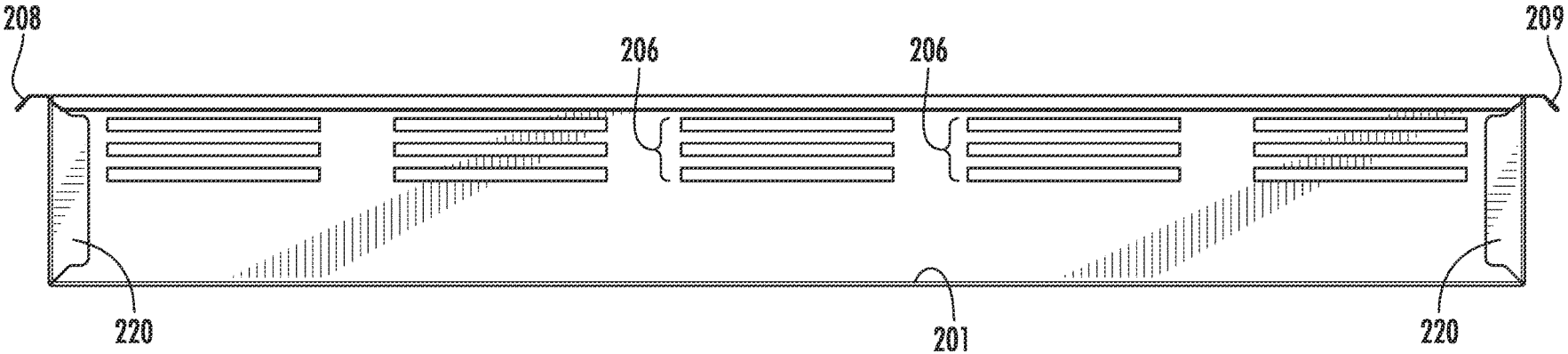
FIG. 5 is a perspective view of the rear wall of the second exemplary warming drawer insert.

FIG. 5 is a perspective view of the rear wall (201). As shown, the side flanges (208 and 209) extend outward from the side walls (202 and 203). In particular, the side flanges first extend outwards at a perpendicular, ninety-degree angle from the side wall, and then angle downwards. As a result, the perpendicular portion of the flange suspends the warming drawer insert (200) in the warming drawer (10) by resting on the side and rear walls (11, 12, and 13) of the warming drawer, and the downward-angled portion of the flange extends beyond the walls of the warming drawer, allowing the insert to be easily grasped and lifted out of the warming drawer.

FIG. 5 also depicts the side tabs (220) of the side walls. These side tabs are folded over to cover a portion of the rear wall and front wall (204) (not shown) and function as attachment points. As a result, the side walls of the warming drawer insert can be identical pieces, reducing manufacturing and tooling costs. The side tabs can be secured to the rear or front wall by any suitable attachment method.

Figure 6:
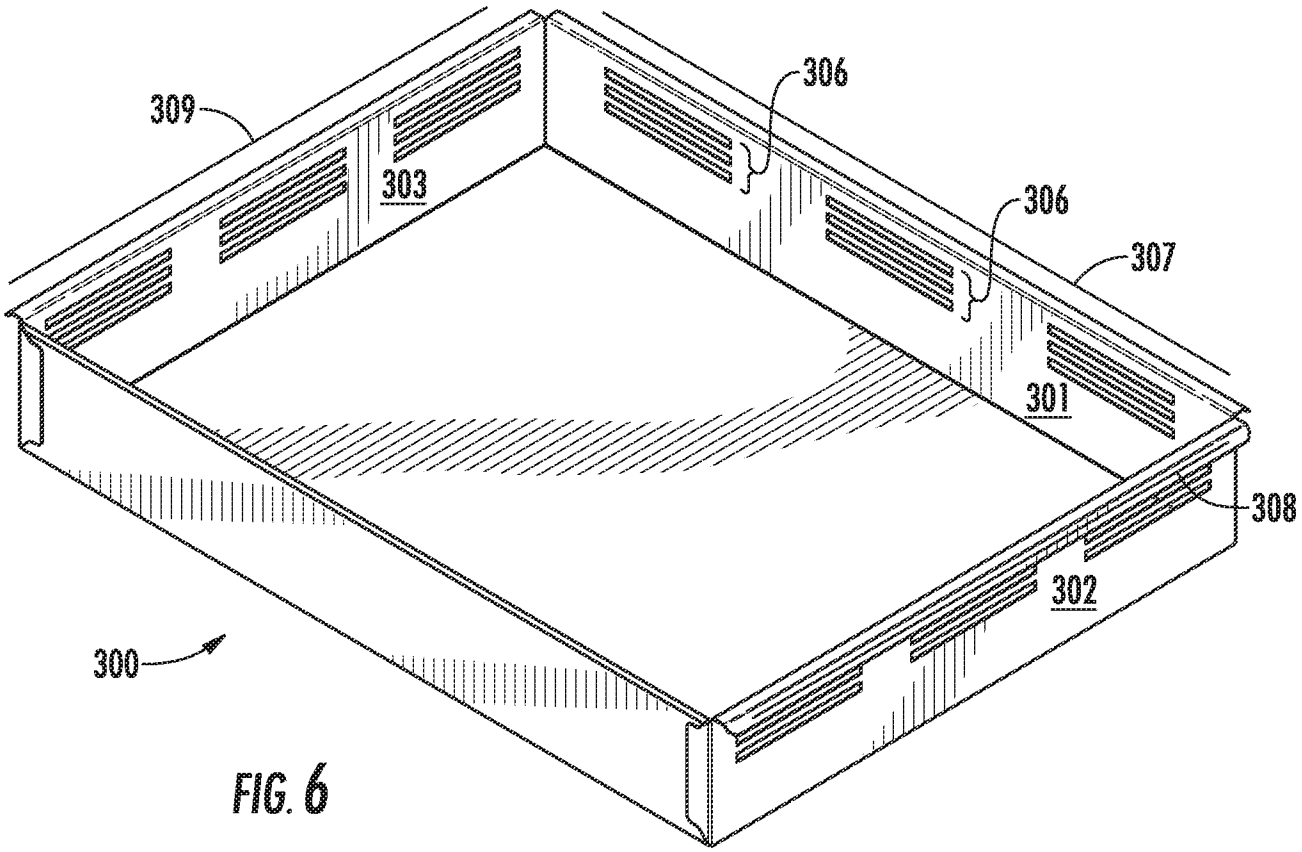
FIG. 6 is a perspective, upper view of a third exemplary warming drawer insert.

FIG. 6 depicts another example of a warming drawer insert (300), having a rectangular shape, flanges (307, 308, 309) along the side and rear walls (301, 302, 303), and slots (306) functioning as vents. In contrast to the warming drawer insert of FIGS. 2 and 4, the insert of FIG. 6 has slots in an alternative arrangement to allow for different convective heating patterns.

Figure 7:
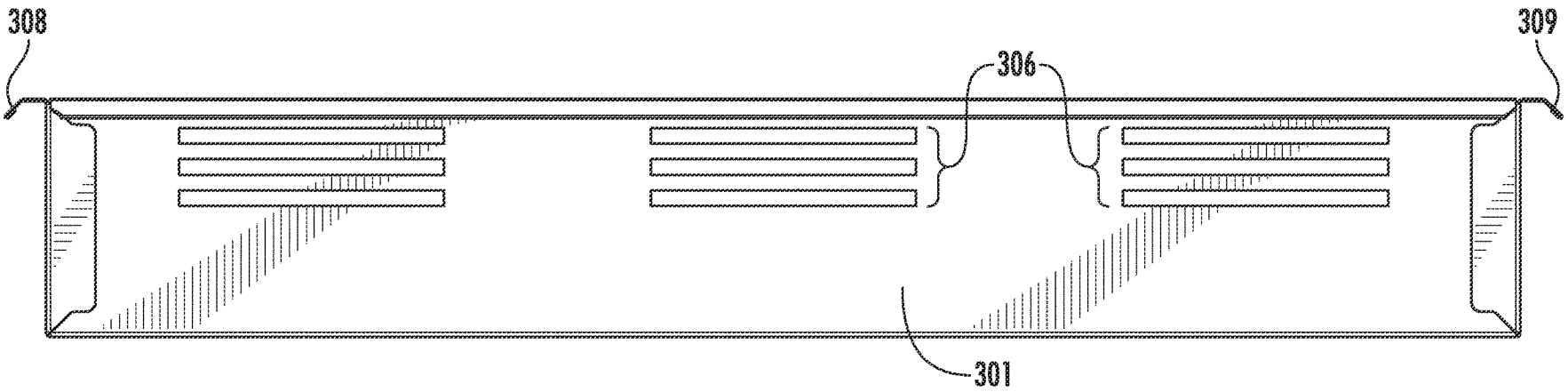
FIG. 7 is a perspective view of the rear wall of the third exemplary warming drawer insert.

FIG. 7 is a perspective view of the rear wall (301). As shown, in this example the slots are positioned in three groups of three.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

The invention claimed is:

1. An insert, comprising:

a base;

a plurality of walls attached to the base, the plurality of walls and base defining a warming area;

a supporting flange extending out from at least one wall of the plurality of walls; and a plurality of openings in the at least one wall, each opening of the plurality of openings forming a vent to allow for convective heating of the warming area, wherein the vent is constructed as a louver which extends outward from the at least one wall.

2. The insert of claim 1, wherein the insert is situated in a heated drawer.

3. The insert of claim 1, wherein the plurality of walls includes a front wall, a first side wall, a second side wall, and a rear wall.

4. The insert of claim 3, wherein the first side wall and the second side wall are identical.

5. The insert of claim 3, wherein the first side wall, the second side wall, and the rear wall each have the supporting flange.

6. The insert of claim 3, wherein the first side wall, the second side wall, and the rear wall each have a set of openings of the plurality of openings.

7. The insert of claim 1, wherein the louver extends outward from the at least one wall along a downward angle.

8. The insert of claim 2, wherein the heated drawer supplies heat to the insert.

9. The insert of claim 2, wherein the insert is suspended in the heated drawer by the supporting flange.

10. The insert of claim 1, the insert being constructed out of a heat-conducting material.

11. A warming drawer apparatus, comprising:

a warming drawer;

a heating device for generating heat in the warming drawer; and a warming drawer insert, the insert having:

a base, a plurality of walls attached to the base, the plurality of walls and base defining a warming area, a supporting flange extending out from at least one wall of the plurality of walls, and a plurality of openings in the at least one wall, each opening of the plurality of openings forming a vent to allow for convective heating of the warming area by the heating device, wherein the warming drawer insert is supported in the warming drawer by the supporting flange.

12. The warming drawer apparatus of claim 11, wherein the plurality of walls includes a front wall, a first side wall, a second side wall, and a rear wall.

13. The warming drawer apparatus of claim 12, wherein the first side wall and the second side wall are identical.

14. The warming drawer apparatus of claim 12, wherein the first side wall, the second side wall, and the rear wall each have the supporting flange.

15. The warming drawer apparatus of claim 12, wherein the first side wall, the second side wall, and the rear wall each have a set of openings of the plurality of openings.

16. The warming drawer apparatus of claim 11, wherein the vent is constructed as a louver which extends outward from the at least one wall along a downward angle.

17. The warming drawer apparatus of claim 11, wherein the warming drawer insert is constructed out of a heat-conducting material.

18. The warming drawer apparatus of claim 12, wherein inserting the warming drawer insert into the warming drawer results in an air gap being formed between warming drawer and the first side wall, the second side wall, and the rear wall of the warming drawer insert.

19. A cooking appliance, the cooking appliance comprising:

an oven cavity;

a warming drawer, the warming drawer having a heating device for generating heat in the warming drawer; and a warming drawer insert in the warming drawer, the insert having:

a base, a plurality of walls attached to the base, the plurality of walls and base defining a warming area, a supporting flange extending out from at least one wall of the plurality of walls and fit over a wall of the warming drawer such that an air gap is formed between the at least one wall of the plurality of walls and the wall of the warming drawer, and a plurality of openings in the at least one wall, each opening of the plurality of openings forming a vent in communication with the air gap to allow for convective heating of the warming area by the heating device.

20. The cooking appliance of claim 19, wherein the supporting flange forms at least one handle configured for removing the warming drawer insert from within the warming drawer.

* * * * *